US012800158B2

(12) United States Patent
Talalas

(10) Patent No.: US 12,800,158 B2
(45) Date of Patent: Nov. 17, 2026

(54) WINDOW HVAC HOUSING, COMPONENTS AND ASSEMBLIES, AND METHODS OF ASSEMBLY AND INSTALLATION

(71) Applicant: INTUS Windows LLC, Fairfax, VA (US)

(72) Inventor: Rolandas Talalas, Haymarket, VA (US)

(73) Assignee: INTUS Windows LLC, Fairfax, VA (US)

( * ) Notice: Subject to any disclaimer, the term of this patent is extended or adjusted under 35 U.S.C. 154(b) by 100 days.

(21) Appl. No.: 18/678,225

(22) Filed: May 30, 2024

(65) Prior Publication Data

US 2024/0401821 A1 Dec. 5, 2024

Related U.S. Application Data

(60) Provisional application No. 63/607,145, filed on Dec. 7, 2023, provisional application No. 63/504,989, filed on May 30, 2023.

(51) Int. Cl.

| | |
|---|---|
| ***F24F 1/031*** | (2019.01) |
| ***F24F 13/20*** | (2006.01) |
| ***F24F 13/32*** | (2006.01) |

(52) U.S. Cl.

CPC ..... *F24F 1/031* (2019.02); *F24F 13/20* (2013.01); *F24F 13/32* (2013.01); *F24F 2221/20* (2013.01)

(58) Field of Classification Search

CPC .. F24F 1/031; F24F 1/027; F24F 13/20; F24F 13/32; F24F 2221/20; F24F 11/89

See application file for complete search history.

(56) References Cited

U.S. PATENT DOCUMENTS

| | | | | |
|---|---|---|---|---|
| 2021/0010688 | A1* | 1/2021 | Biasotti | F24F 13/20 |
| 2021/0071903 | A1* | 3/2021 | Baumann | F24F 13/20 |
| 2023/0366588 | A1* | 11/2023 | Choi | F24F 13/32 |

* cited by examiner

*Primary Examiner* — Joseph F Trpisovsky

(74) *Attorney, Agent, or Firm* — Nemphos Braue LLC; Michael Antone

(57) ABSTRACT

Improved window HVAC housings and installation methods reduce unwanted heat transfer through the window areas in which the window-based HVAC equipment, such as air conditioners including heat pumps and fans, are installed. An insulating pane may be installed in lieu of or combination with a window in a wall, wherein the insulating pane is configured to pass a heat exchanger connector connecting heat exchangers on opposing sides of the insulating pane. A heat exchanger sleeve may be provided to pass the heat exchanger connector and may provide support for the connector and/or HVAC equipment. An interior or exterior housing portion may be provided. The interior housing portion may include an accessible front portion and HVAC support to support installed HVAC equipment. The exterior housing portion may be attached to the window frame, insulating pane, and/or interior housing and may be installed from inside the building.

10 Claims, 13 Drawing Sheets

WINDOW HVAC HOUSING, COMPONENTS AND ASSEMBLIES, AND METHODS OF ASSEMBLY AND INSTALLATION

CROSS-REFERENCE TO RELATED APPLICATIONS

This application claims the benefit of and priority to U.S. Provisional Patent Application Nos. 63/504,989 filed May 30, 2023, and 63/607,145 filed Dec. 7, 2023, the disclosure of each is incorporated herein by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to HVAC units for use in windows. More specifically, the invention relates to improved window HVAC housings to be installed in windows in buildings to house window-based HVAC units, such as air conditioners including heat pumps, fans, etc.

Background

Window-based HVAC equipment, in particular air conditioners, are used throughout the world in buildings that do not have central HVAC systems or to supplement central HVAC systems. One of the challenges with window-based HVAC equipment is that the equipment is generally designed to fit in a wide range of windows, which generally results in an opening on one or both sides and possibly an air gap between the top and bottom of the equipment and the window. The openings and air gaps are generally filled using side curtains, channels, gaskets, etc. to reduce, and eliminate, if possible, the flow of air between the inside and outside around the equipment.

While the curtains and gaskets may be effective in reducing or even eliminating the air flow around the equipment, the equipment and associated installation components generally represent a significant source of heat transfer (heat loss/gain) in a building that may make it difficult to comply with various building regulations and decrease the level of comfort in the room when not in use. Some window-based HVAC equipment is designed to be easily removed when not in use. However, the removal and storage of the equipment when not in use can be very expensive in buildings employing a large number of units and/or have limited storage.

As regulations are continually tightened, it may prove more and more difficult to use window-based HVAC equipment and comply with the regulations. As such, there is a continuing need for window-based HVAC equipment and accessories that reduce unwanted heat transfer and enable equipment to be maintained in an installed state.

BRIEF SUMMARY OF THE INVENTION

The present invention addresses the above noted needs by providing improved window HVAC housings that reduce unwanted heat transfer through the window areas in which the window-based HVAC equipment, such as air conditioners including heat pumps and fans, are installed.

In various embodiments, the housing of the present invention may include an interior housing configured to fit within or attached to or proximate the window frame and cooperate with an insulating pane installed in place of or in combination with a windowpane. The interior housing may further include a front door or removable front portion to enclose the portion of the HVAC equipment located in the interior of the building when not in use.

The insulating pane may be comprised of various materials, such as single or multiple layered opaque or transparent materials and includes an opening sized to receive the HVAC equipment. In various embodiments, the opening in the insulating pane may be cut to fit during installation of the HVAC equipment and housing or pre-fit to receive standard size HVAC equipment. The housing may further include flanges mounted on the interior and/or exterior sides of the insulating pane to provide additional support for the HVAC equipment and/or air flow and/or thermal seals. In various embodiments, fasteners may be employed to physically attach the HVAC equipment to the interior housing and/or the insulating pane.

The housing may further include an exterior housing portion that may be attached to the window frame, insulating pane, and/or the interior housing. In various embodiments, the exterior may be installed from inside the building to eliminate the need for exterior installation steps.

The housing may be configured to accommodate various types of HVAC equipment, such as single or multiple chassis equipment. For example, in traditional window HVAC equipment, such as cooling only air conditioners and heat pumps, the condensing and evaporating heat exchangers and compressor are contained within a single chassis that is mounted in a window opening. In multiple chassis, e.g., 2, equipment, the condensing and evaporating heat exchangers may be housed in separate chassis that are connected to allow refrigerant to flow between the interior and exterior heat exchangers. The multiple chassis equipment may be employed for form factor and/or performance reasons.

It may be desirable to exclude the interior and/or exterior housing portions in geographies where the HVAC equipment is embodied as a heat pump that is used for both heating and cooling during most of the year. In those embodiments, the window may have a glass pane portion and an insulating pane portion that is configured to house the HVAC equipment and may include one or both of the interior and exterior housing portions. For example, if may be desirable to have an exterior housing portion in geographic areas that experience temperatures that reduce the performance of the exterior heat exchangers. Similarly, it may be desirable to include an interior housing portion when the HVAC equipment is not in use.

The improved window-based HVAC housings of the present invention address the continuing need for window-based HVAC equipment installation that provide enhanced safety and thermal performance and enable building owners to comply with various regulations concerning buildings and HVAC equipment.

BRIEF DESCRIPTION OF THE DRAWINGS

The accompanying drawings are included for the purpose of exemplary illustration of various aspects of the present invention, and not for purposes of limiting the invention, wherein.

Figure 1A:
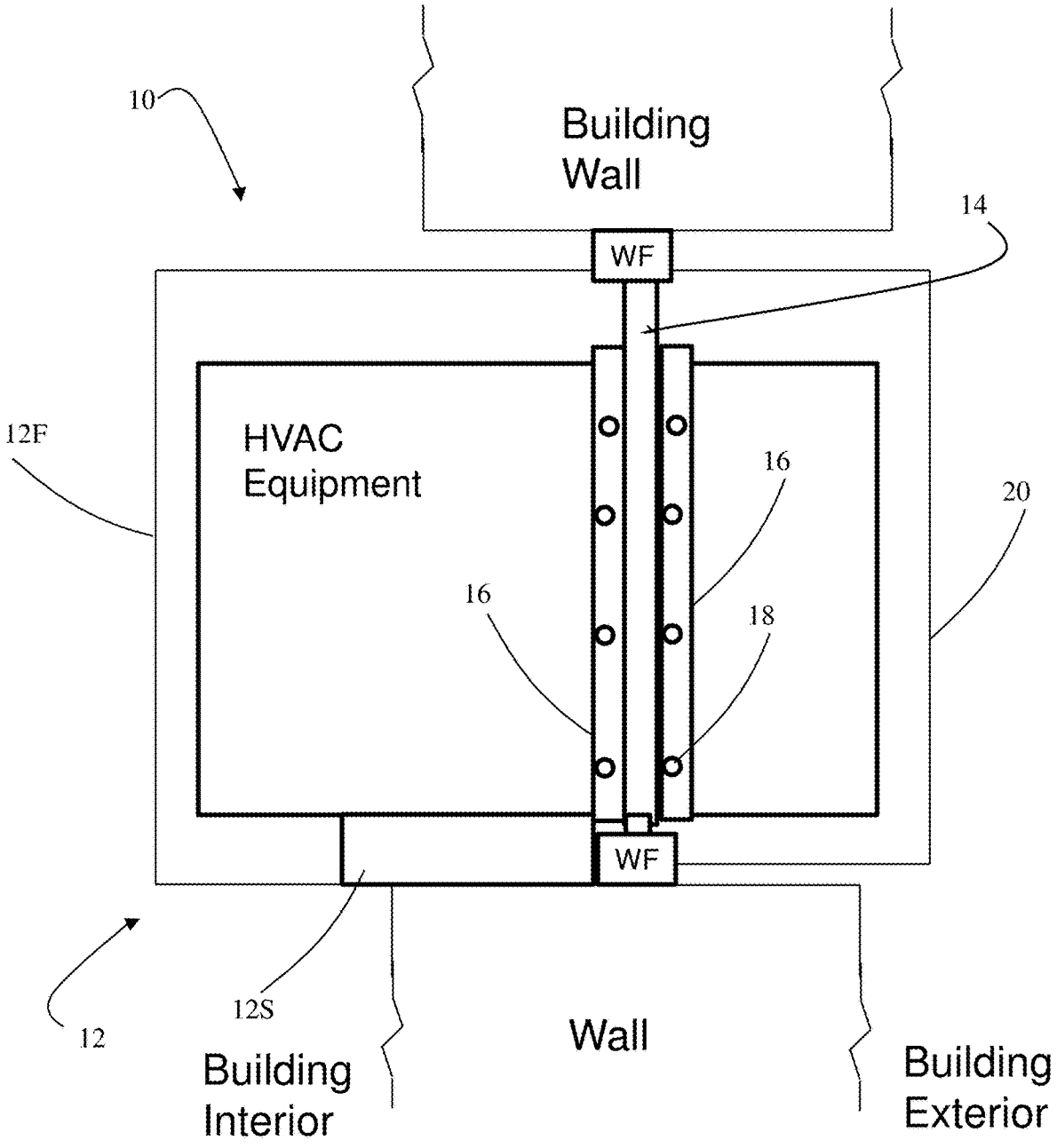
FIGS. 1A-1D depict a cross-sectional view of the housing system proximate one side of HVAC equipment.

In the drawings and detailed description, the same or similar reference numbers may identify the same or similar elements. It will be appreciated that the implementations, features, etc. described with respect to embodiments in specific figures may be implemented with respect to other embodiments in other figures, unless expressly stated, or otherwise not possible.

DETAILED DESCRIPTION OF THE INVENTION

The improved window HVAC housing systems 10 of the present invention reduce unwanted heat transfer through window areas in which window-based HVAC equipment, e.g., window air conditioning including heat pumps, fan units, etc., is installed thereby improving the overall thermal performance of building.

Figure 1B:
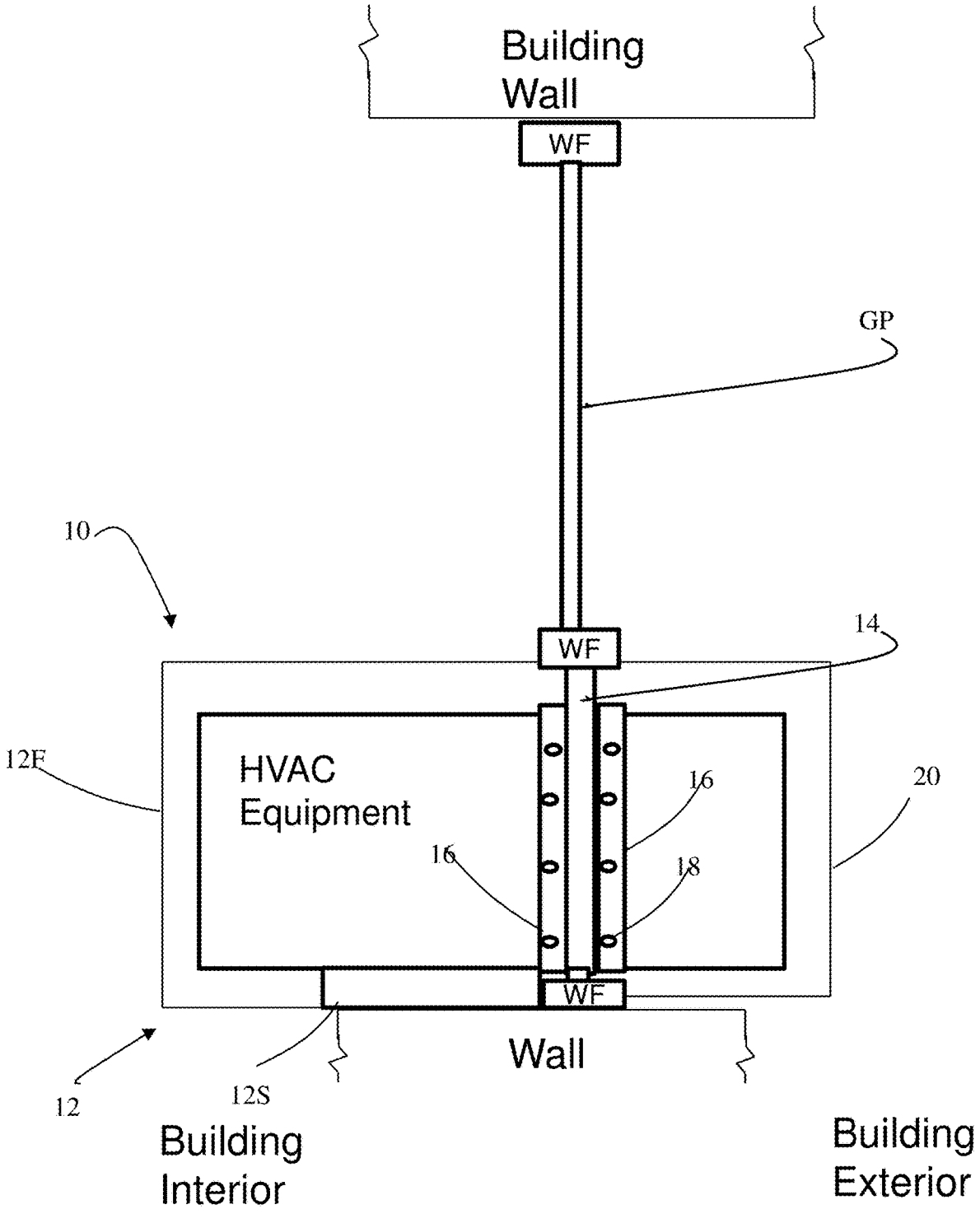
Figure 1C:
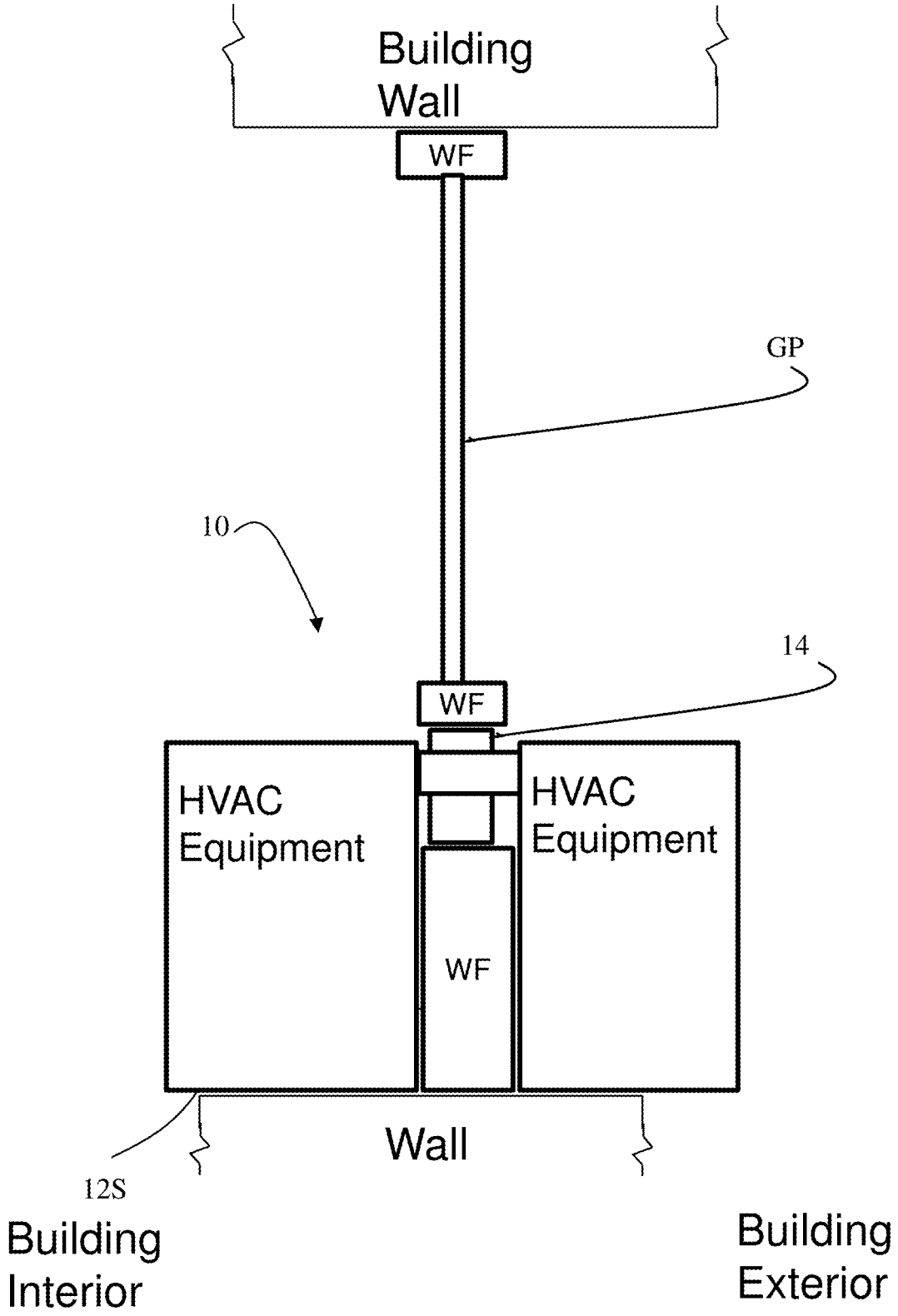
Figure 1D:
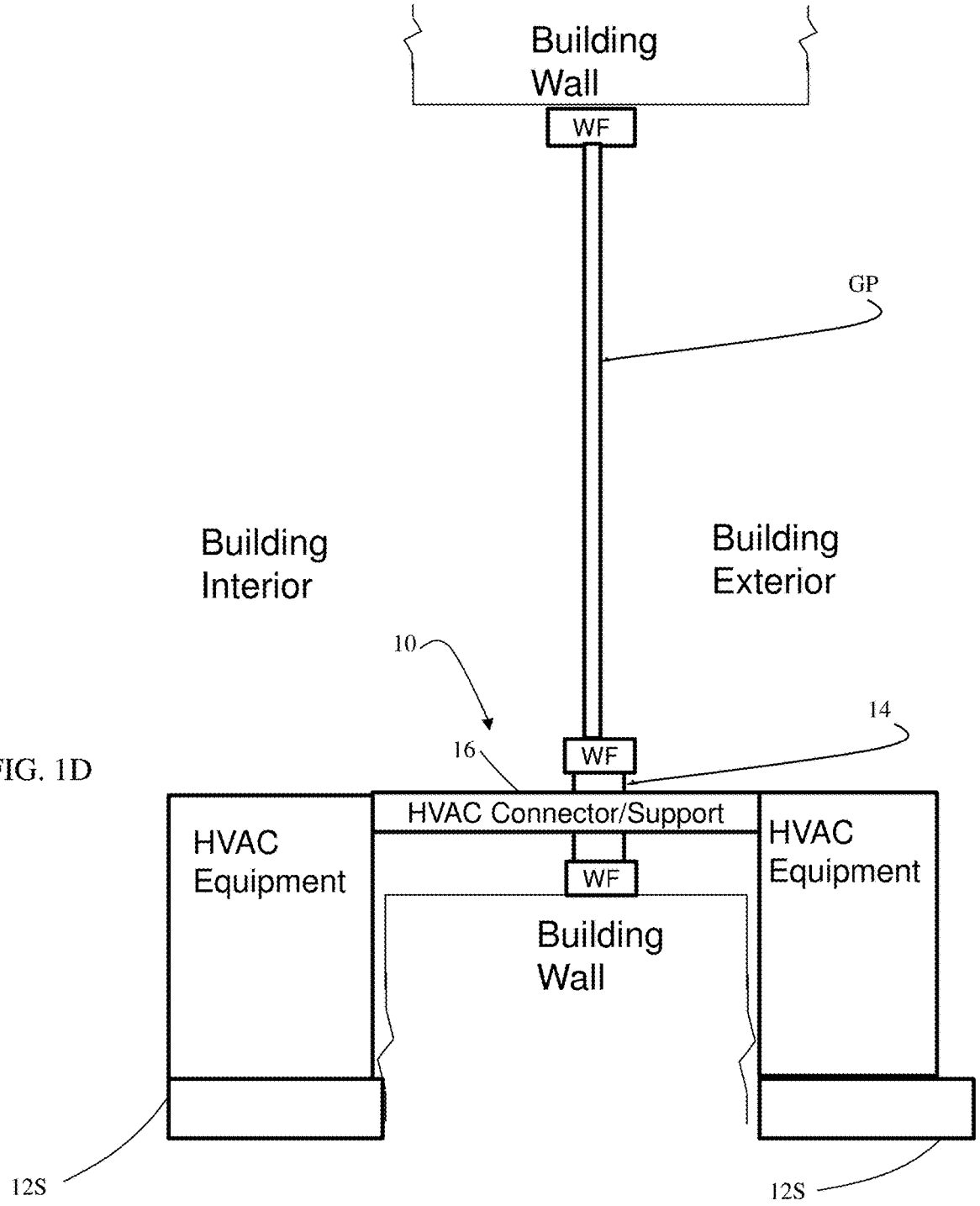

FIGS. 1A-1D depict housing systems installed in a one-section window frame (WF) (FIG. 1A) and a two-section window frame (FIG. 1B-1D). FIGS. 1B-1D depicts the HVAC equipment deployed in the lower section of the window frame with the upper section including one or more glass panes (GP), which may be comprised of various materials having various levels of transparency as desired by, or required of, the building owner. It will be appreciated that the HVAC equipment may be deployed in the upper section, e.g., transom, and that additional sections may also be provided in the window frame.

FIGS. 1B-1D further depict the HVAC equipment housed in a single chassis (FIG. 1B) and two chassis in which at least one heat exchanger is deployed in each of the interior and exterior of the building and the heat exchangers are connected (FIGS. 1C & 1D). In FIG. 1C embodiments, the HVAC equipment is supported inside the window opening and the lower section of the window frame is sized to accommodate the HVAC equipment within the window opening. In FIG. 1D embodiments, the HVAC equipment is suspended and/or supported outside the window opening by the HVAC connector/support and the section of the window frame in which the HVAC equipment is installed may be reduced in size enabling either a large section for the glass pane or a small window opening in the building. FIGS. 1C & 1D embodiments may be employed in HVAC scenarios in which the HVAC equipment remains installed year-round or seasonally removed, but may be particularly desirable when the HVAC equipment remains installed year-round, such as with heat pumps may be used to provide heating and cooling, because it provides a skilled artisan more opportunity to various the size of the glass pane GP in the window to the architectural design of the building.

It will be appreciated that in FIG. 1D embodiments, the second section of the window including the insulating pane may be smaller than the vertical direction than the one or both of the interior and exterior heat exchangers and other components in the HVAC equipment since the HVAC equipment is positioned outside the window opening. In these embodiments, the insulating pane 14 may be reduced in the vertical direction, thereby enabling the first section including the glass pane to be maximized or increased a desired amount. When the HVAC equipment is installed outside of the window opening supports 12S may be provided proximate the HVAC equipment and/or the HVAC connector/support.

In some deployment scenarios, it may be desirable for the HVAC Connector 16 to provide mechanical support for the HVAC equipment without additional support structure installed inside or outside of the building wall. For example, if the second section including the insulating pane 14 is vertically below the first section glass pane, then HVAC equipment may be suspended from the HVAC connector 16. Whereas, if the second section including the insulating pane 14 is vertically above the first section glass pane, the HVAC connector 16 may be integrated or deployed with a shelf portion to support the heat exchanger and other HVAC equipment.

In various embodiments, the housing system 10 may include an interior housing 12 configured to fit within or attached to or proximate the window frame WF and/or a building wall W surrounding the window opening, such as shown in FIGS. 1A, 1B, 2A, & 2B. The interior housing 12 may further include a front door or removable front portion 12F to enclose the portion of the HVAC equipment located in the interior of the building when not in use. Front door of the front portion 12F may be opened via hinges or retractable and stored within the interior housing portion 12. In various embodiments, the front portion 12F may be insulated to provide a desired R-value when the front portion 12F is closed enclosing the HVAC equipment on the inside of the building.

An insulating pane 14 may be installed within an opened window in an existing window or in lieu of the window in new construction or window retrofit applications. The insulating pane 14 may be comprised of various materials, such as single or multiple layered opaque or transparent materials, such as glass, compliant forms, plastics, etc., that provide a desired level of thermal insulation and aesthetics. The insulating pane 14 generally has an interior side with an interior surface that faces the interior of the building and an exterior side with an exterior surface that faces the exterior of the building, when installed.

The insulating pane 14 may include an opening sized to receive the HVAC equipment. In various embodiments, the opening in the insulating pane 14 may be cut to fit during installation of the HVAC equipment and housing or pre-cut to receive standard size HVAC equipment.

The housing system 10 may further include flanges 16 mounted on the interior and/or exterior sides of the insulating pane 14 to provide support for the HVAC equipment. The flanges 16 may include various types of air and water flow and thermal seals and may be physically attached the HVAC equipment and/or the insulating pane 14 by one or more types of fasteners 18. In various embodiments, the interior and exterior flanges 16 may be connected through the insulating pane 14, which may be used to further distribute the weight of the HVAC equipment. While FIG. 1 depicts discrete fasteners, it will be appreciated that more continuous engagement fasteners, such as adhesives, tongue & groove, etc., may be employed in lieu of or combination with discrete point fasteners.

In various embodiments, the interior housing portion 12 may include an HVAC support 12S positioned within or proximate the interior housing portion 12 to provide interior support for the weight of the HVAC equipment, e.g., on the window ledge. The HVAC equipment may be fastened to the HVAC support 12S or freely rest upon the support 12S. It will be appreciated that the HVAC support 12S may be a separate component from the interior housing portion 12.

The housing system 10 may further include an exterior housing portion 20 that may be attached to the window frame WF, wall, insulating pane 14 and/or the interior housing 12. In various embodiments, the exterior portion 20 may be installed from inside the building to eliminate the need for exterior installation steps. The exterior portion 20 may be configured to serve various purposes, such as to protect the equipment from the outside environment, aesthetics, control exterior air flow, etc. For example, the exterior portion 20 may support exterior air flow to the HVAC equipment and manage condensate flow from the HVAC equipment, if any. Also, the exterior housing may be configured to significantly reduce or eliminate air flow in a region proximate to the insulating pane 14, while supporting necessary airflow to and from the HVAC equipment, to reduce the heat transfer. In other embodiments, the interior and exterior housings may include additional insulating material proximate the insulating pane 14.

Figure 2A:
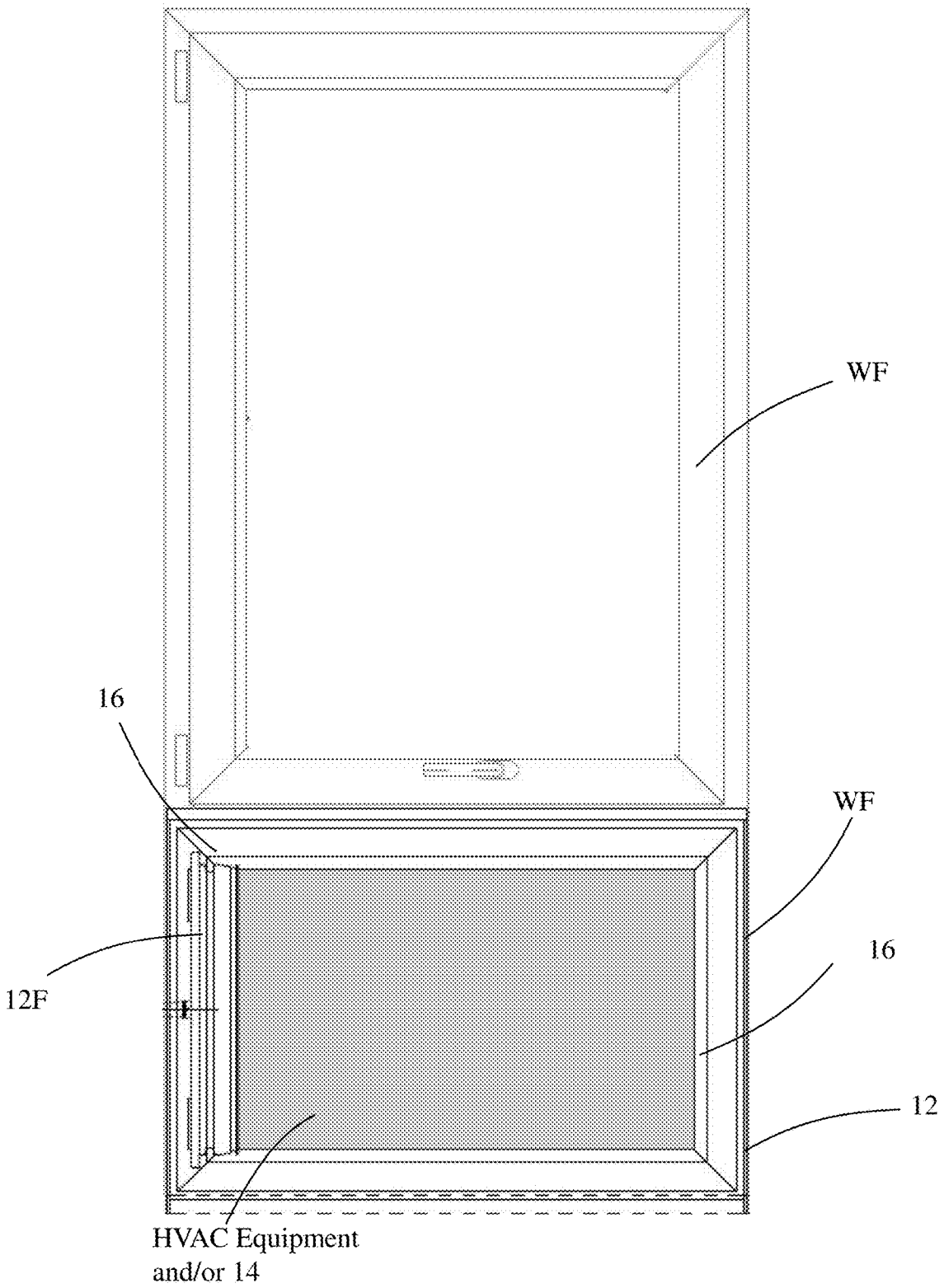
FIGS. 2A-2C show various views of exemplary HVAC equipment and HVAC housing system installed in a window.
Figure 2B:
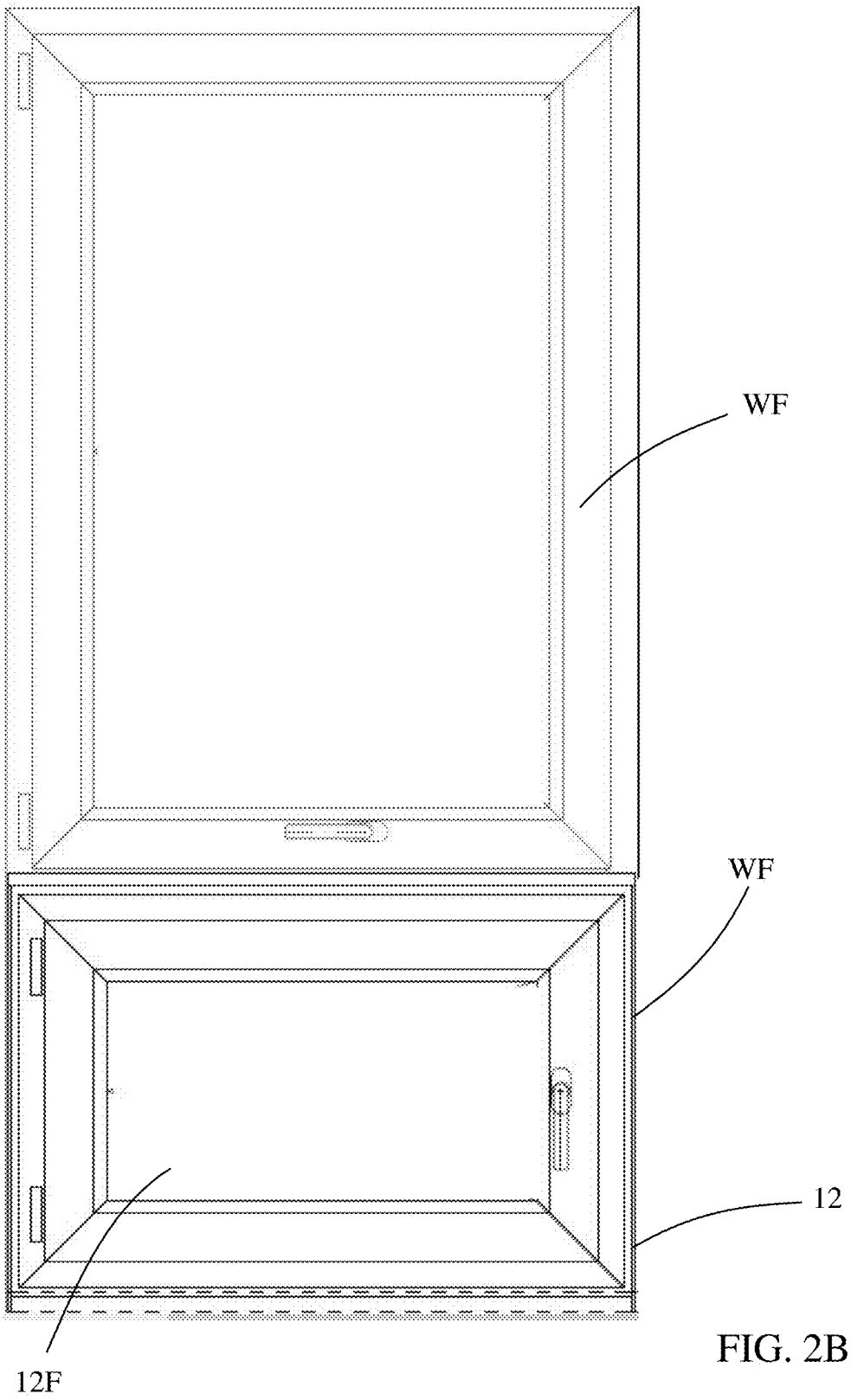
Figure 2C:
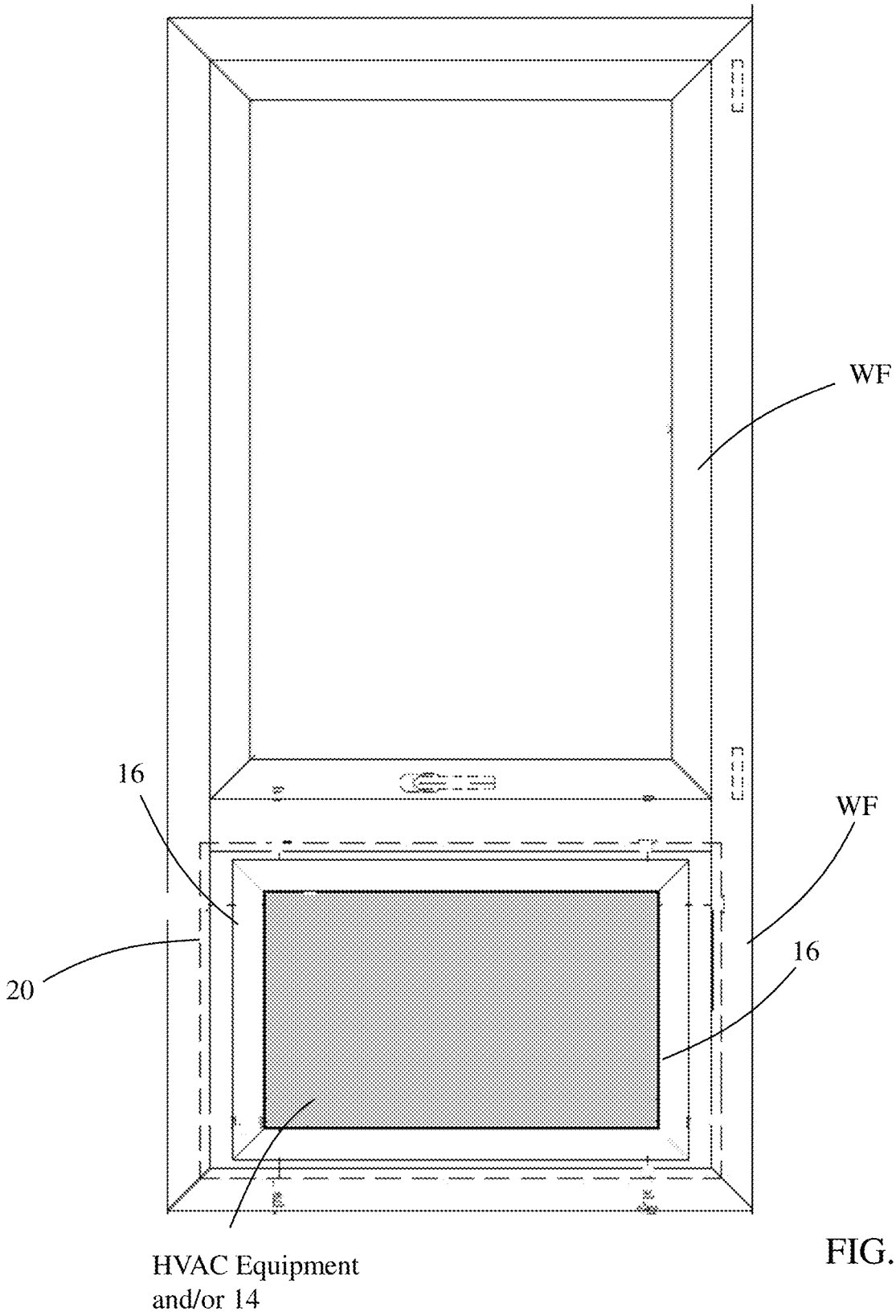

FIGS. 2A-2C show various views of exemplary HVAC equipment and HVAC housing system installed in a window. In FIGS. 2A-2C, a two-section window structure is shown without the supporting walls and other building structure.

FIG. 2A depicts a front interior view of the system 10 installed with the interior housing 12 fully enclosing the area of the window in which the HVAC equipment is installed. The front portion 12F of the interior housing 12 may be embodied as a door that is opened to reveal the HVAC equipment and surrounding flanges 16. In the depicted embodiment, the opening revealed by the front portion may be limited to revealing only the HVAC equipment or may reveal the insulating pane 14 as well.

FIG. 2B depicts embodiments, such as in FIG. 2A, with the front portion 12F closed to enclose the HVAC equipment at least from the interior of the building.

FIG. 2C depicts embodiments, such as in FIGS. 2A & 2B, facing the system 10 from the exterior. The exterior housing 20 is cut away and shown as dashed lines to reveal the HVAC equipment and/or insulating pane 14 and exterior flanges 16.

Figure 3:
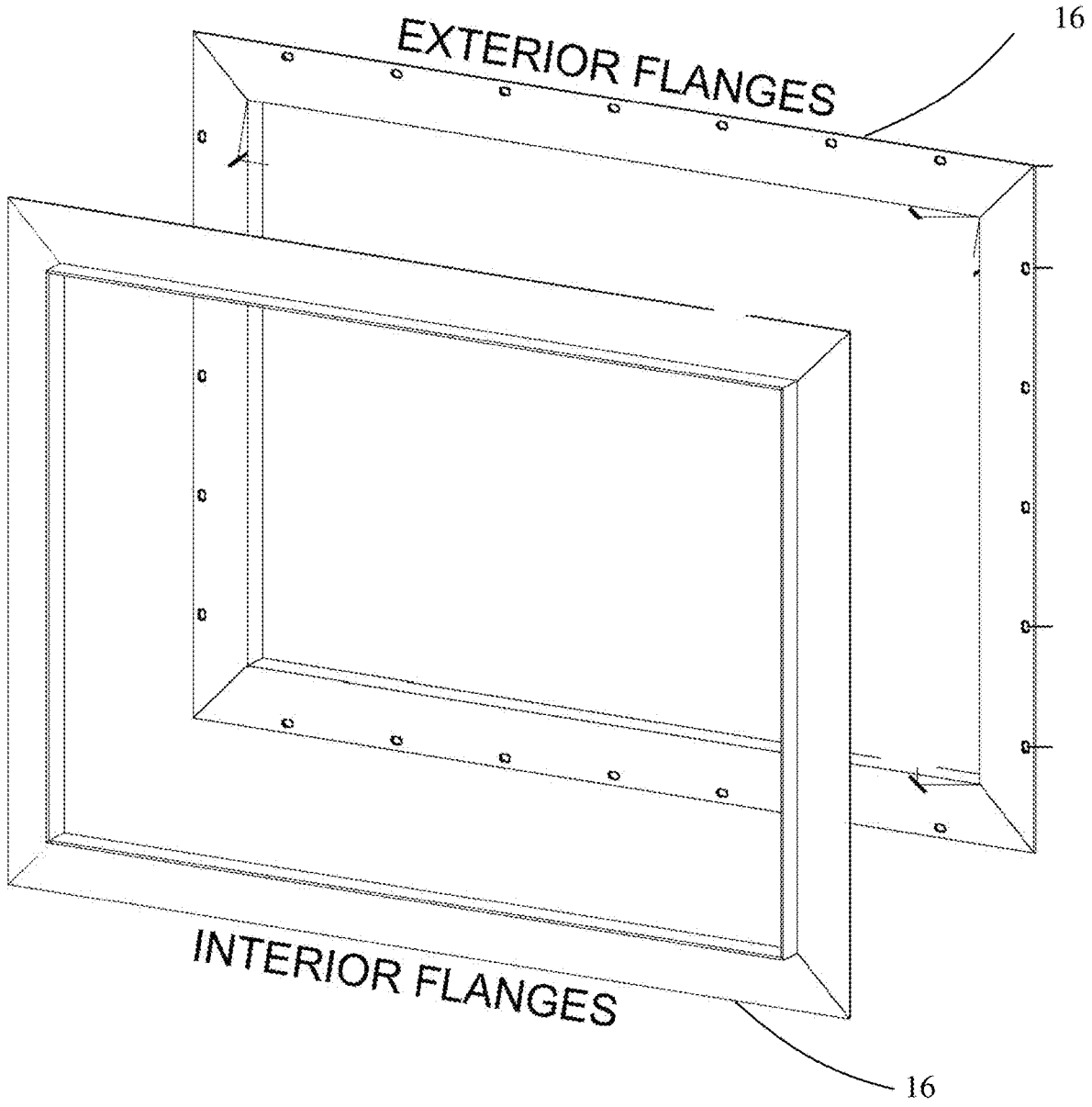
FIG. 3 depicts a perspective view of exemplary interior and exterior flanges.

FIG. 3 shows exemplary flanges 16 that may be used in the system 10. While it is generally desirable to include both interior and exterior flanges provide air flow and thermal resistance, there may be applications in which either the interior or exterior flange is not used and/or the flanges 16 does not cover the full perimeter of the HVAC equipment.

Figure 4:
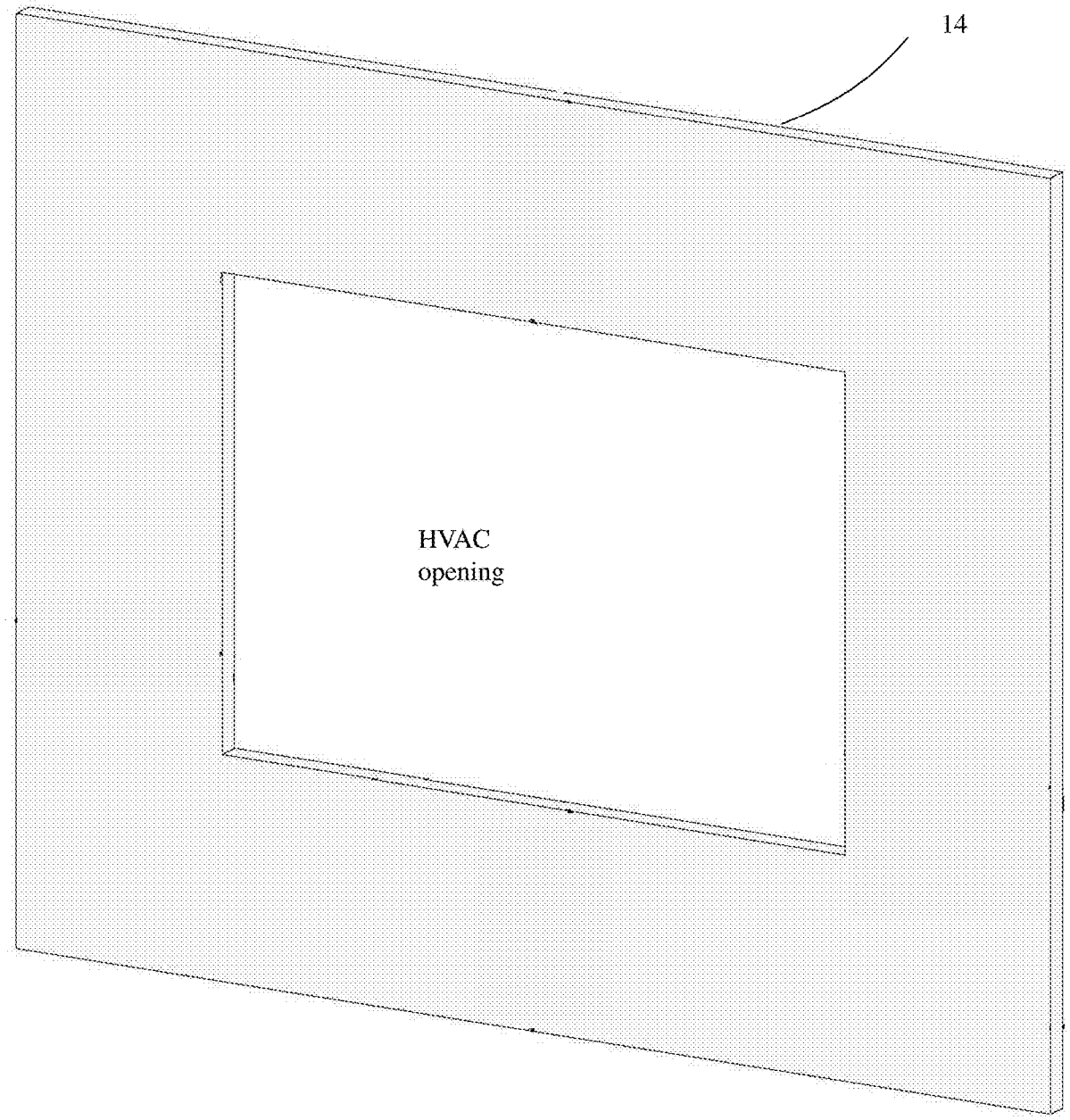
FIG. 4 depicts a perspective view of exemplary insulating pane.
Figure 5:
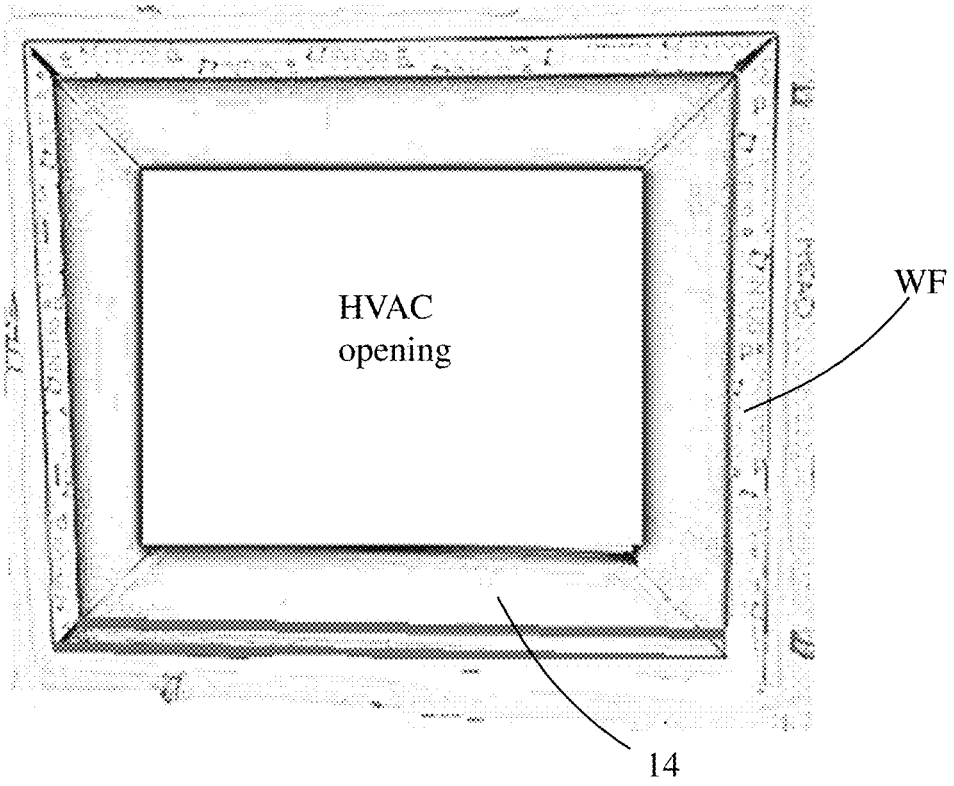
FIG. 5 depicts a perspective view of exemplary installed insulating pane.

FIGS. 4 & 5 depict exemplary embodiments of the insulating pane 14, which includes an opening sized to receive HVAC equipment. FIG. 5 depicts the insulating pane 14 of FIG. 4 installed in a window frame WF. As noted above, the insulating pane 14 may be composed of various materials and employ various designs to provide the desired air flow, thermal, and aesthetic performance. For example, in various embodiments where the insulating pane 14 may not be visible following installation, aesthetics may not be a significant consideration.

In various embodiments, the system 10 may include an electrical connection from the interior side of the HVAC equipment to provide a sealed electrical connection.

In the operation of embodiments, such as those shown in FIGS. 1A and 1B, the front portion 12F may be opened or retracted if implemented as a door or removed as desired by the user. When the HVAC equipment is not in use, the front portion 12F may be closed or reinstalled if removed.

Figure 6A:
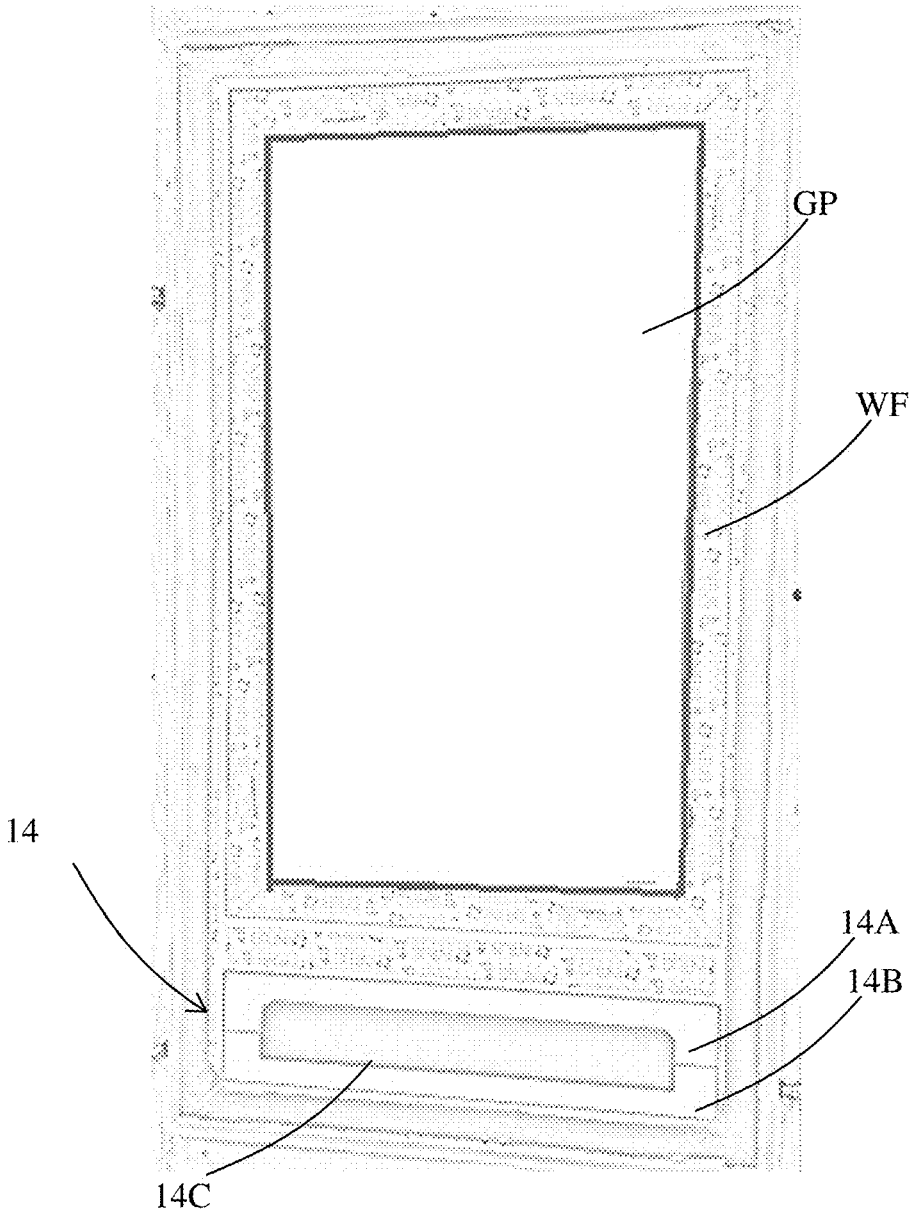
FIG. 6A depicts a perspective view of various installed two-section window embodiments without the heat exchangers.

FIG. 6A shows a front perspective view of embodiments, such as those shown in FIGS. 1C & 1D without the HVAC equipment. The insulating pane 14 may be comprised of one or multiple portions as desired by the skilled artisan to achieve aesthetic and functional objective, such as providing an air & watertight seal around the HVAC connector/support. For example, the insulating pane 14 may include first and second portions, 14A & 14B, that cooperate to secure the HVAC equipment connector/support in place. The insulating pane 14 may further include a sleeve 14C to retain the HVAC equipment connector/support.

Figure 6B:
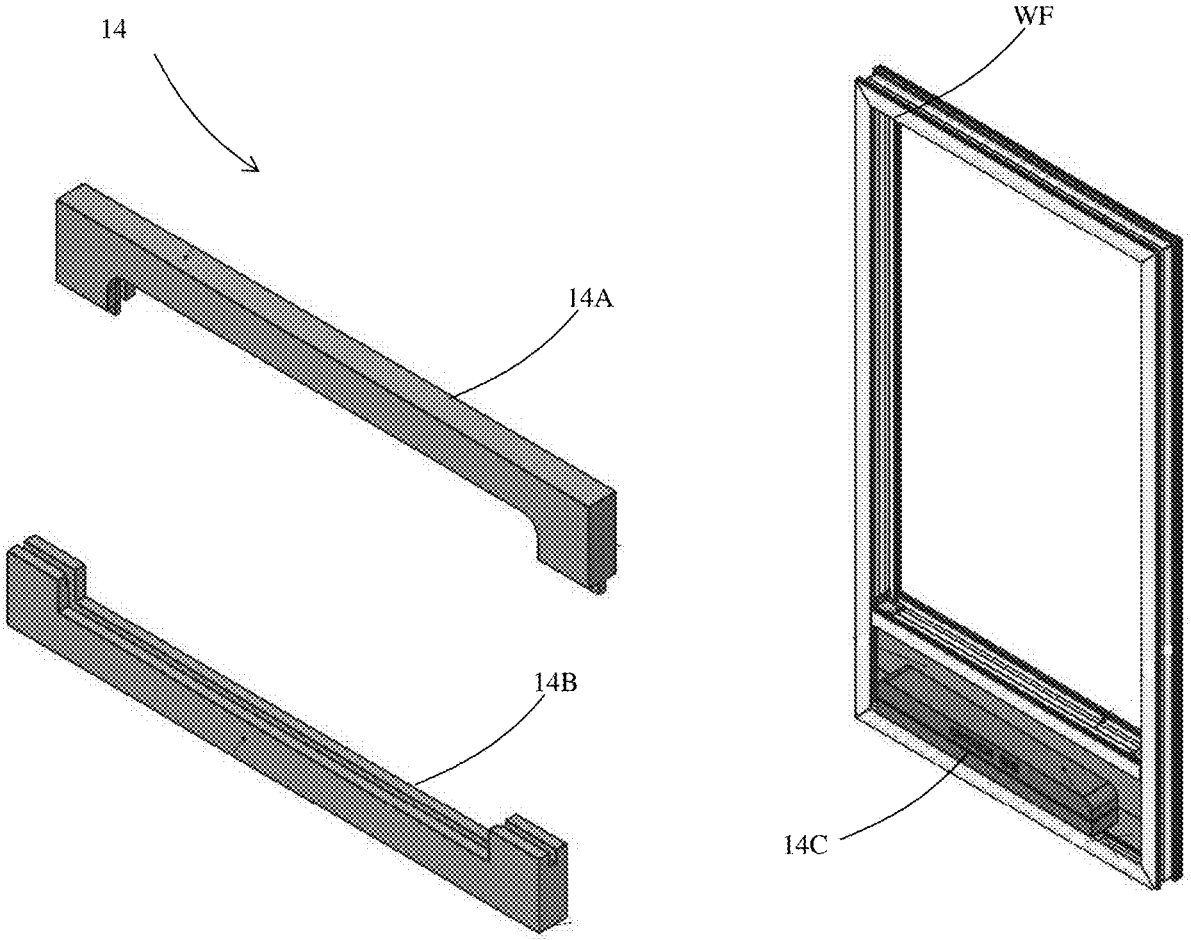
FIG. 6B depicts a perspective view of various installed two-section window embodiments without the heat exchangers and a partially exploded insulating pane.

FIG. 6B is a partially exploded view of the insulating pane 14 from the window with the first and second portions 14A & 14B removed from the window. One of skill in the art will appreciate that the first and second portions 14A & 14B may be comprised of a material that has good insulating properties and is sufficiently compliant to enable a tight seal. In various embodiments, flanges 16, gaskets, and other seals, such as those described above may be employed in these embodiments.

Figures 6C, 6D:
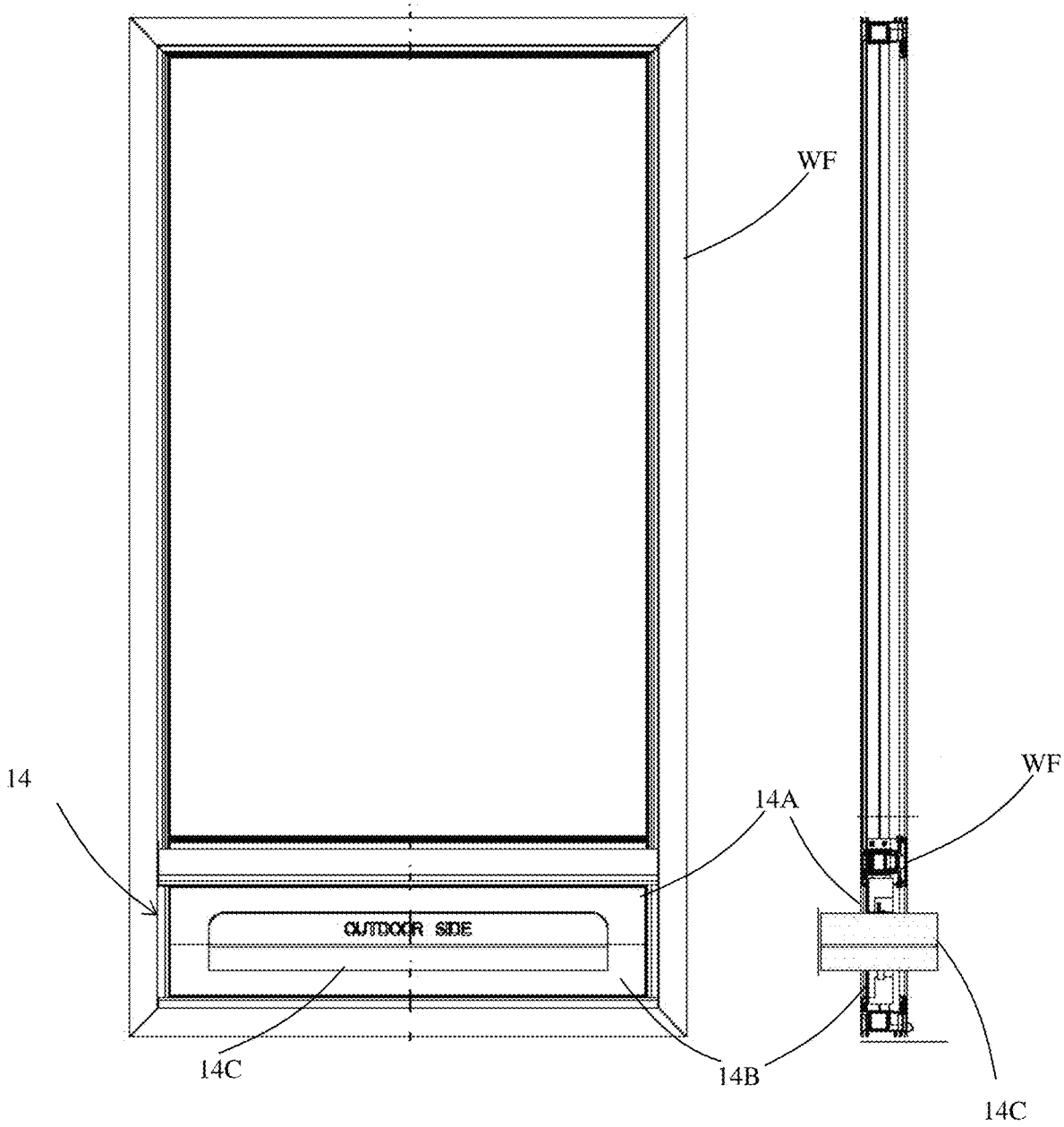
FIGS. 6C & 6D depict an outside-in view and a cut-away side cross-sectional view of various uninstalled two-section window embodiments without the heat exchangers, respectively.

FIGS. 6C & 6D depict uninstalled embodiments of a two-section window similar to the installed embodiments in FIG. 6A. These embodiments may be employed in installations such as those depicted in FIGS. 1C & 1D. In various embodiments, the isolating panel 14 may be partially or fully installed during or after the window installation. For example, a removable muntin may be employed to separate the insulating pane 14 from the glass pane GP. FIGS. 6C & 6D embodiments are particularly useful in deployment scenarios, where the HVAC equipment is used for a significant portion of the year, such as with heat pumps (FIGS. 1C & 1D) that may be used to provide heating and cooling, and it is desirable to maximize the glass pane of the window. It will be appreciated that electric heaters and coolers and other HVAC equipment may be used to augment the heating and cooling capacity of the heat pump, cooling air conditioners, and fans.

The foregoing disclosure provides examples, illustrations and descriptions of the present invention, but is not intended to be exhaustive or to limit the implementations to the precise form disclosed. Modifications and variations are possible in light of the above disclosure or may be acquired from practice of the implementations. These and other variations and modifications of the present invention are possible and contemplated, and it is intended that the foregoing specification and the following claims cover such modifications and variations.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items and may be used interchangeably with "one or more." Furthermore, as used herein, the term "set" is intended to include one or more items and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A window-based HVAC equipment housing assembly comprising an insulating pane having interior and exterior sides and including an opening to receive HVAC equipment;

an interior housing portion connected at least proximate to the insulating pane to enclose a portion of the HVAC equipment within the interior housing portion, the interior housing portion including a front portion providing access to the enclosed portion of the HVAC equipment and an interior HVAC support;

an interior and exterior flange positioned proximate the opening and fastened to the insulating pane and the HVAC equipment to provide a thermal seal between the interior and exterior sides of the insulating pane via the opening when the HVAC equipment is present; and an exterior housing portion connected at least proximate to exterior side of the insulating pane to enclose a portion of the HVAC equipment and provide exterior air flow to the HVAC equipment.

2. The assembly of claim 1, where the HVAC equipment is one of an air conditioner, a fan, and a heat pump.

3. The assembly of claim 1, where the front portion of the interior housing portion is a door configured to provide access to a portion of the HVAC equipment within the interior housing portion.

4. The assembly of claim 1, where the interior housing portion fully encloses the HVAC equipment extending from the interior side of the insulating pane.

5. The assembly of claim 1, where the exterior housing portion fully encloses the exterior side of the insulating pane.

6. The assembly of claim 1, where the front portion of the interior housing is an insulated panel.

7. The assembly of claim 1, where the portion of the HVAC equipment within the interior housing portion is an interior heat exchanger, the portion of the HVAC equipment within the exterior housing portion is an exterior heat exchanger, where the interior and exterior heat exchanger are connected via a heat exchanger connector passing through the insulating pane.

8. The assembly of claim 1, further comprising a heat exchanger sleeve configured to pass the heat exchanger connector.

9. The assembly of claim 8, where the interior and exterior heat exchangers are configured as a heat pump.

10. A window-based HVAC equipment housing assembly comprising an insulating pane having interior and exterior sides and including an opening configured to pass to a heat exchanger connector connecting an interior heat exchanger with an exterior heat exchanger;

an interior housing portion connected at least proximate to the insulating pane to enclose the interior heat exchanger within the interior housing portion, the interior housing portion including a front portion providing access to the interior heat exchanger and an interior HVAC support;

an interior and exterior flange positioned proximate the opening and fastened to the insulating pane and the heat exchanger connector to provide a thermal seal between the interior and exterior sides of the insulating pane via the opening when the heat exchanger connector is present; and an exterior housing portion connected at least proximate to exterior side of the insulating pane to enclose the exterior heat exchanger and provide exterior air flow to the exterior heat exchanger.

* * * * *